US007210271B2

(12) United States Patent
Wheeler

(10) Patent No.: US 7,210,271 B2
(45) Date of Patent: May 1, 2007

(54) HEADER APPARATUS AND METHOD FOR A STRUCTURAL FRAMING SYSTEM

(75) Inventor: Frank Wheeler, Oklahoma City, OK (US)

(73) Assignee: Flexability Concepts LLC, Edmond, OK (US)

( * ) Notice: Subject to any disclaimer, the term of this patent is extended or adjusted under 35 U.S.C. 154(b) by 0 days.

(21) Appl. No.: 10/245,070

(22) Filed: Sep. 17, 2002

(65) Prior Publication Data

US 2004/0049997 A1 Mar. 18, 2004

(51) Int. Cl.
*E04G 11/06* (2006.01)

(52) U.S. Cl. ..... 52/245; 52/247; 52/85; 52/86; 52/745.07

(58) Field of Classification Search ..... 52/241, 52/245, 247, 108, 293.3, 483.1, 745.05, 745.09, 52/745.1, 745.11, 745.13, 745.14, 481.1
See application file for complete search history.

(56) References Cited

U.S. PATENT DOCUMENTS

| | | | | |
|---|---|---|---|---|
| 0,545,884 | A | 9/1895 | Fry et al. | |
| 0,951,011 | A | 3/1910 | Lambert | |
| 1,032,284 | A | 7/1912 | Holland | |
| 1,714,174 | A | 5/1929 | Lichtenberg et al. | |
| 2,127,806 | A | 8/1938 | Burt | |
| 2,197,318 | A | 4/1940 | Rumble | |
| 2,269,384 | A | 1/1942 | Spinosa | |
| 2,419,321 | A | 4/1947 | Lopes | |
| 2,612,854 | A | 10/1952 | Fuge | |
| 2,745,277 | A | 5/1956 | Nelsson | |
| 2,832,445 | A * | 4/1958 | Burgin | 52/483.1 |
| 2,941,371 | A | 6/1960 | Benedict et al. | |
| 3,034,609 | A * | 5/1962 | Young | 52/241 |
| 3,053,358 | A | 9/1962 | Gross | |
| 3,260,022 | A | 7/1966 | Guyer et al. | |
| 3,317,927 | A | 5/1967 | Shields | |
| 3,428,969 | A | 2/1969 | Diemond et al. | |
| 3,465,488 | A * | 9/1969 | Miller | 52/481.1 |
| 3,604,203 | A | 9/1971 | Hofmann | |
| 3,703,061 | A | 11/1972 | Holland et al. | |
| 3,778,939 | A * | 12/1973 | Nelsson | 52/36.6 |
| 3,893,269 | A | 7/1975 | Nelsson et al. | |
| 3,925,875 | A | 12/1975 | Doke | |

(Continued)

FOREIGN PATENT DOCUMENTS

EP 0119514 B1 7/1988

*Primary Examiner*—Jeanette Chapman
(74) *Attorney, Agent, or Firm*—Mitchell K. McCarthy

(57) ABSTRACT

An apparatus and associated method for a header in a structural framing system comprising a pair of track members defining opposing receiving portions. A plurality of column members is disposed substantially transversely to the track members and joined thereto. A web member is receivingly engaged in the receiving portions and spans the column members. The track members can be characteristically longitudinally arcuate and the web member characteristically conformable to the arcuate shape of the track members. In one illustrative embodiment the track members can comprise a plurality of flexibly joined sections that are moveable to define a selected arcuate longitudinal shape. A retaining member is adapted for retaining the flexibly joined sections in the selected shape. A fixing member is adapted for fixing the web member to one or more column members and/or one or more of the track members after the track members achieve the selected shape.

24 Claims, 7 Drawing Sheets

U.S. PATENT DOCUMENTS 4,055,922 A 11/1977 Ellington et al.
4,376,361 A 3/1983 Michael
4,566,141 A * 1/1986 Mahoney ..... 4/506
4,575,979 A 3/1986 Mariani
4,894,962 A 1/1990 Conn
5,063,717 A 11/1991 Quaranta et al.
5,087,397 A 2/1992 Martinez
5,090,170 A 2/1992 Propst
5,284,199 A 2/1994 Finch et al.
5,291,717 A 3/1994 Turner
5,394,665 A 3/1995 Johnson
5,402,612 A 4/1995 diGirolamo et al.
5,572,834 A 11/1996 Lilly
5,590,493 A 1/1997 Wilson
5,655,344 A * 8/1997 Moen et al. ..... 52/238.1
5,671,583 A 9/1997 Turner
5,724,778 A 3/1998 Cornell et al.
5,755,066 A * 5/1998 Becker ..... 52/241
5,765,330 A * 6/1998 Richard ..... 52/309.13
5,857,300 A 1/1999 Gates
5,950,385 A * 9/1999 Herren ..... 52/481.1
6,000,181 A 12/1999 Wheeler
6,047,512 A 4/2000 Wendt et al.
6,088,970 A * 7/2000 Doran ..... 52/92.1
6,094,877 A 8/2000 White
6,115,984 A * 9/2000 Paradis ..... 52/717.03
6,134,844 A 10/2000 Cornell et al.
6,176,053 B1 * 1/2001 St. Germain ..... 52/232
6,237,301 B1 * 5/2001 Paradis ..... 52/717.03
6,341,460 B1 1/2002 Lalvani
6,345,480 B1 2/2002 Kemper et al.
6,625,942 B1 9/2003 Wheeler
6,637,173 B1 10/2003 Wheeler
6,655,100 B1 * 12/2003 Andino ..... 52/247
6,854,237 B2 * 2/2005 Surowiecki ..... 52/633

* cited by examiner

HEADER APPARATUS AND METHOD FOR A STRUCTURAL FRAMING SYSTEM

FIELD OF THE INVENTION

This invention relates generally to the field of structural framing systems and more particularly without limitation to an apparatus and associated method for framing a header structural member.

BACKGROUND OF THE INVENTION

Recent developments in devices and methods used to construct structural framing systems have resulted in a proliferation in the use of nonlinear architecture such as curved walls, columns and barrel ceilings. These developments include flexible framing systems that are selectively conformable to a desired arcuate shape and then fixable to retain that shape. Where framing curved structures once required expert framing skill, they can now be achieved by one of relatively little framing experience with such a flexible framing system.

For example, flexible framing systems are used in constructing curved walls. Generally, this type of flexible framing system comprises an opposing pair of longitudinally disposable track members with a plurality of studs transversely interposed therebetween. In some cases, the track members are preformed to the desired arcuate shape. Preferably, for more flexibility, the track members can comprise a plurality of flexibly joined segments that are moveable to achieve the desired shape. The track members, in turn, locate the studs so as to define the curved wall frame. A wall covering, such as gypsum board or paneling, can then be attached to the wall frame to complete the curved wall.

Presently, flexible framing systems are limited in use to non-load-bearing, or interior partition wall portions of a structural framing system. This means that curved architecture in a load-bearing member requires custom fabrication by a highly skilled framing craftsperson. A header member for an opening in a curved wall, such as for a passageway or a window, is one example of such a load-bearing member requiring custom fabrication.

It has been determined, however, that sufficient structural integrity can be achieved in a flexible header apparatus by ultimately tying the opposing track members and the studs together by a compliant web member. By defining receiving portions in the track members, the web member can be slidingly supported so as to conform to the selective shaping and/or placement of the track members. After the desired shape is achieved, the web member can be fixed to the studs and/or to the track members to produce an operatively unitary structural member. It is to these improvements and others as exemplified by the description and appended claims that embodiments of the present invention are directed.

SUMMARY OF THE INVENTION

Embodiments of the present invention are directed to a header apparatus for a structural framing system. The apparatus comprises a pair of track members defining opposing receiving portions. A plurality of column members is disposed substantially transversely to the track members and joined thereto. A web member is receivingly engaged in the receiving portions and spans the column members.

In one embodiment the receiving portion is defined between the track members and the columns. The first of the pair of track members comprises a lateral segment and a flange extending substantially orthogonally from the lateral segment. Likewise, the second of the pair of track members comprises a lateral segment disposable substantially parallel to the first track member lateral segment and a flange opposing the first track member flange. Each of the adjacent lateral segments and flanges intersect to define the respective receiving portions.

Alternatively, the receiving portions can be solely defined by the track members. The first of the pair of track members comprises a lateral segment and a bifurcated flange extending substantially orthogonally from the lateral segment. The bifurcated flange comprises a first segment disposed substantially along a first longitudinal plane and a second segment disposed substantially along a second longitudinal plane spatially disposed from the first longitudinal plane establishing a longitudinal gap therebetween defining the receiving portion. Likewise, the second of the pair of track members comprises a lateral segment disposable substantially parallel to the first track member lateral segment and a bifurcated flange opposing the first track member bifurcated flange with a third segment disposed substantially along a third longitudinal plane and a fourth segment disposed substantially along a fourth longitudinal plane spatially disposed from the third longitudinal plane establishing a longitudinal gap therebetween defining the opposing receiving portion.

In one aspect of the apparatus the track members are characteristically arcuate and the web member is characteristically conformable to the shape of the track members. For example, the track members can comprise a plurality of flexibly joined sections that are selectively moveable to define a desired shape.

The embodiments of the present invention furthermore contemplate a method for framing a header spanning supporting portions of a structural framing system. The method comprises providing a header apparatus comprising opposing tracks with a plurality of studs interposed substantially transversely therebetween, the tracks defining receiving portions receivingly engaging a structural web member in a sliding relationship between the tracks and the web member, the web member spanning the studs. The method furthermore provides fixing the web member to at least one of the studs.

In one embodiment the method contemplates tracks comprising a plurality of flexibly joined sections. Therein, the method contemplates, after orienting the tracks to a desired longitudinal shape, then retaining the tracks in the desired shape and then fixing the web member to at least one of the studs and/or to at least one of the track members.

In one aspect of the present invention a structural framing system is contemplated, comprising a first structural member, a second structural member spatially disposed from the first structural member, and means for framing a header support member spanning the structural members. The means for framing is characterized by an apparatus comprising a pair of track members defining opposing receiving portions, a plurality of column members disposed substantially transversely to the track members and joined thereto, and a web member receivingly engaged in the receiving portions and spanning the column members.

The means for framing can be characterized by a first of the pair of track members comprising a lateral segment and a flange extending substantially orthogonally from the lateral segment, the second of the pair of track members comprising a lateral segment disposable substantially parallel to the first track member lateral segment and a flange opposing the first track member flange, each of the adjacent lateral segments and flanges intersecting to define the respective receiving portions.

The means for framing can be characterized by a first of the pair of track members comprising a lateral segment and a bifurcated flange extending substantially orthogonally from the lateral segment. The bifurcated flange comprises a first segment disposed substantially along a first longitudinal plane and a second segment disposed substantially along a second longitudinal plane and spatially disposed from the first longitudinal plane establishing a longitudinal gap therebetween defining the receiving portion, the second of the pair of track members comprising a lateral segment disposable substantially parallel to the first track member lateral segment and a bifurcated flange opposing the first track member bifurcated flange with a third segment disposed substantially along a third longitudinal plane and a fourth segment disposed substantially along a fourth longitudinal plane and spatially disposed from the third longitudinal plane establishing a longitudinal gap therebetween defining the opposing receiving portion.

The means for framing can be characterized by the track members being characteristically arcuate and the web member being characteristically conformable to the arcuate shape of the track members. For example, the means for framing can be characterized by at least one of the track members comprising a plurality of flexibly joined sections that are selectively moveable to orient the track member in a desired shape, wherein the web member is characteristically conformable to the desired shape.

These and various other features as well as advantages which characterize the embodiments of the present invention will be apparent upon reading of the following detailed description and review of the associated drawings.

DETAILED DESCRIPTION

Figure 1:
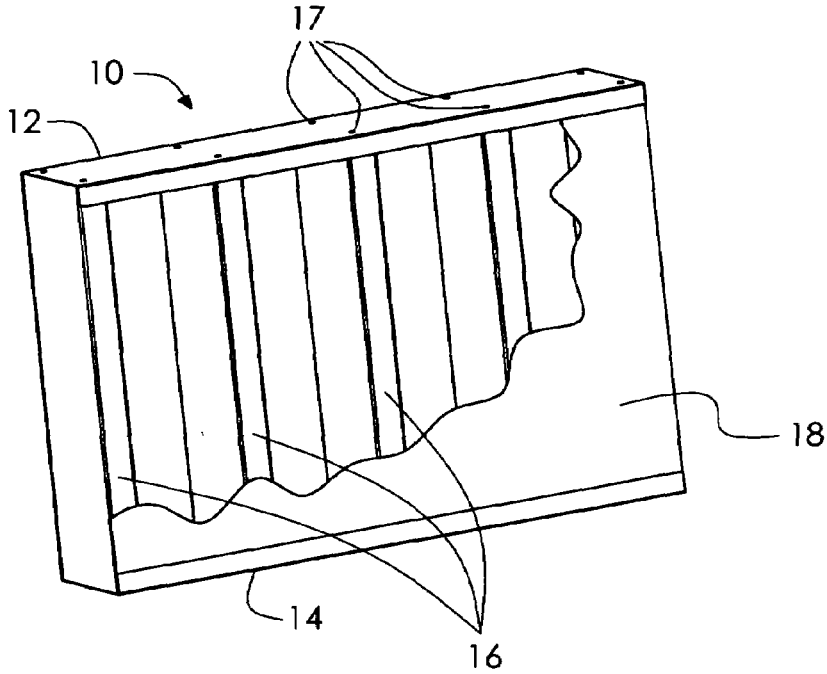
FIG. 1 is a partially cutaway isometric view of a header apparatus for a structural framing system that is constructed in accordance with embodiments of the present invention.

FIG. 1 is a partially cutaway isometric view of a header apparatus 10 for a structural framing system. The header 10 has a first track member 12 and a second track member 14 and a plurality of column members 16 (sometimes referred to as "studs 16") disposed substantially transversely to the track members 12, 14 and joined thereto. The studs 16 can be joined to the track members 12, 14 by fasteners 17. Two fasteners 17 through the track member 12, 14 and into the respective end of the stud 16 prevents rotation of the stud 16 relative to the track member 12, 14. The track members 12, 14 define receiving portions (discussed below) for receivingly engaging a structural web member 18 spanning the column members 16.

Figure 2:
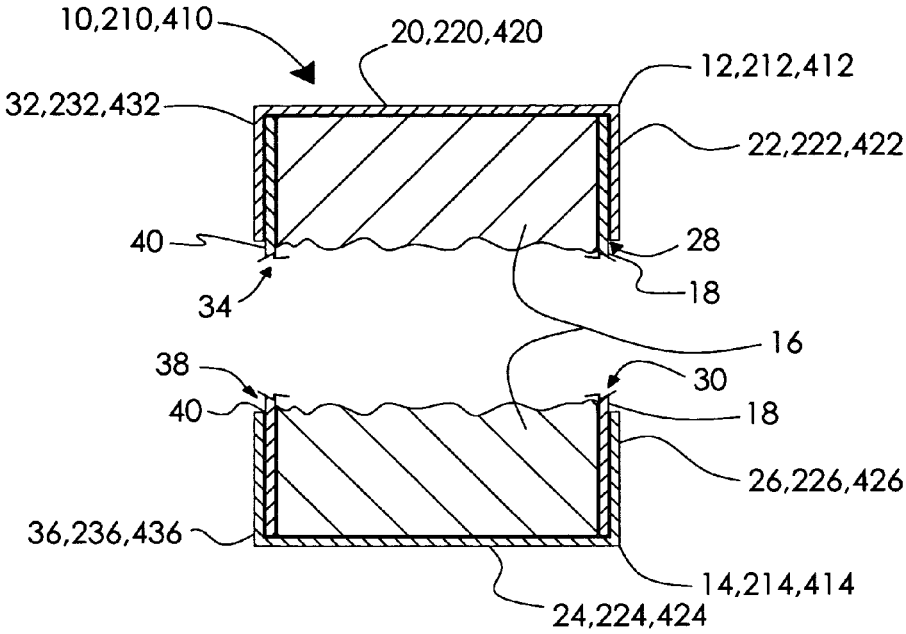
FIG. 2 is a cross sectional view of the header apparatus of FIGS. 1, 6 and 8.

FIG. 2 is a cross sectional view of the header 10 of FIG. 1. The track member 12 comprises a lateral segment 20 and a flange 22 extending substantially orthogonally from the lateral segment 20. The track member 14 comprises a lateral segment 24 disposable substantially parallel to the lateral segment 20 and a flange 26 opposing the flange 22. The lateral segment 20 and the flange 22 intersect to define a receiving portion 28 therebetween. Similarly, the lateral segment 24 and the flange 26 intersect to define an opposing receiving portion 30 therebetween. In the embodiment illustrated in FIG. 2 the stud 16 is sized such that the web member 18 is receivingly engaged in the receiving portions 28, 30 between the stud 16 and the flanges 22, 26.

In one embodiment the header 10 comprises only one web member 18. Alternatively, as in FIG. 2, the track member 12 comprises a pair of flanges 22, 32 defining a substantially u-shaped arrangement with two receiving portions 28, 34. Similarly, the track member 14 comprises a pair of flanges 26, 36 defining a substantially u-shaped arrangement with two receiving portions 30, 38. Accordingly, the header 10 can comprise the first web member 18 receivingly engaged between the studs 16 and the respective opposing flanges 22, 26, as well as a second web member 40 receivingly engaged between the studs 16 and the other opposing flanges 32, 36.

Figure 3:
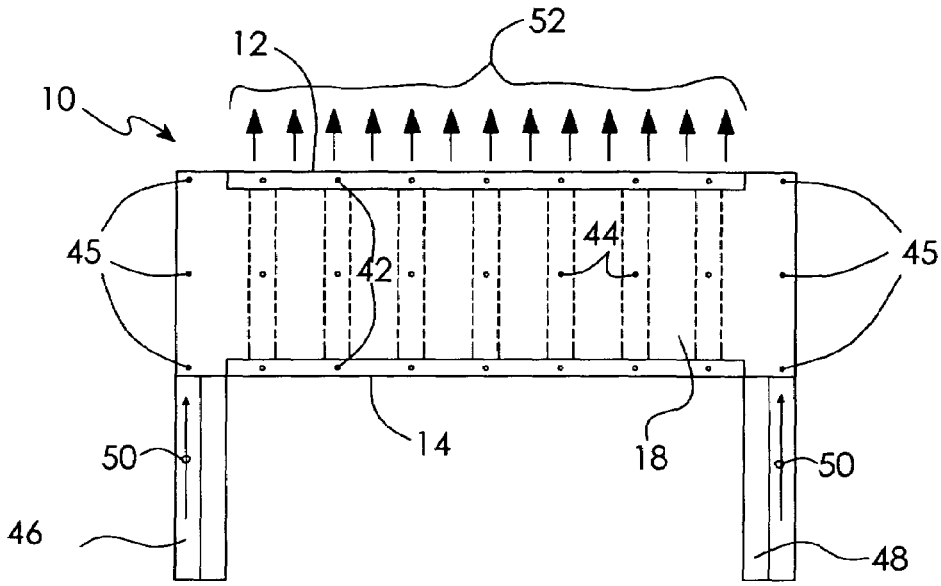
FIG. 3 is a diagrammatic view of the header apparatus of FIG. 1 in the structural framing system.

Referring now to FIGS. 2 and 3, the web member 18 slidingly engages the receiving portions 28, 30. That is, the track members 12, 14 are somewhat movable relative to each other independently of the web member 18. This permits fitting the track members 12, 14 into a framing system, such as illustrated by upright supporting members 46, 48 in FIG. 3, without shear resistance of the web member 18. In this manner, the header 10 is readily adaptable to slightly unlevel or out-of-square conditions present in the supporting members 46, 48. After the track members 12, 14 are attached, the web member 18 can then be fixed to the track members 12, 14 and/or to the studs 16 such as by fixing members 42, 44, respectively. As shown in FIG. 3, the web member 18 can also be extended beyond the track members 12, 14 and fixed directly to the supporting members 46, 48 with fasteners 45. The fixing members 42, 44 can be any type of fastener device such as but not limited to a screw, nail, or interference tab. Fixing the web member 18 to at least one of the studs 16 and/or at least one of the track members 12, 14 forms a unitary structural system transferring the supporting forces 50 of the framing system to a uniform force array 52 along the span of the header 10. Thus, the force array 52 provides structural support for depending a framing structure and associated building products therebeneath, such as a window or a door, and/or for supporting a load from above.

In the embodiments described hereinabove the receiving portions 28, 30 are defined at the intersection of the lateral segments 20, 24 and the respective flanges 22, 26, with the web member 18 receivingly disposed between the studs 16 and the flanges 22, 26. This provides for a relatively simple design, but requires consideration of the stud 16 size and placement in order to define an appropriate clearance with the web member 18. Alternatively, the track members 12, 14 can solely define the receiving portions 28, 30 to eliminate consideration of the stud 16 size and placement.

Figure 4:
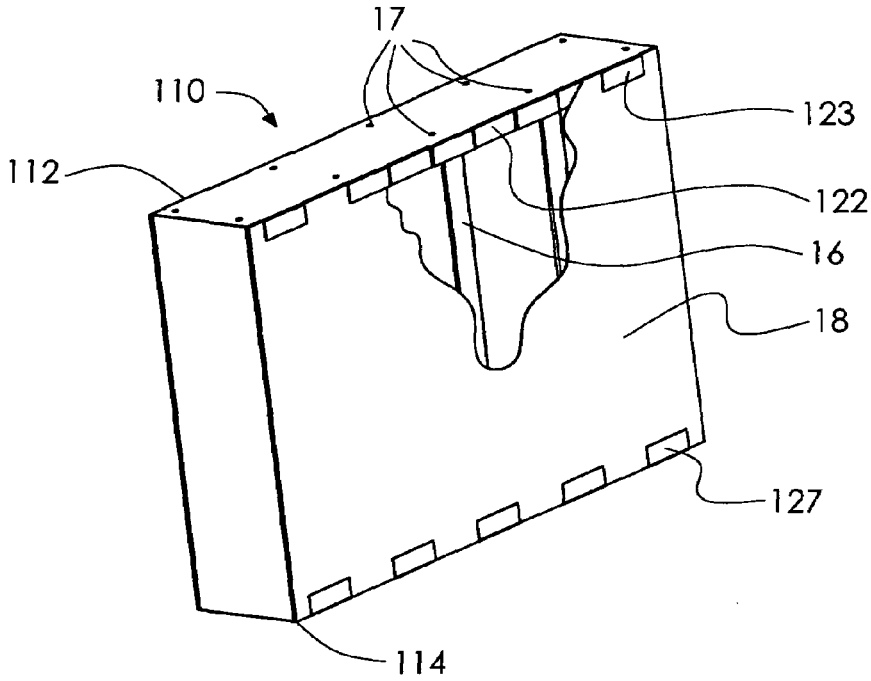
FIG. 4 is a partially cutaway isometric view of a header apparatus similar to FIG. 1 but constructed in accordance with alternative embodiments of the present invention.
Figure 5:
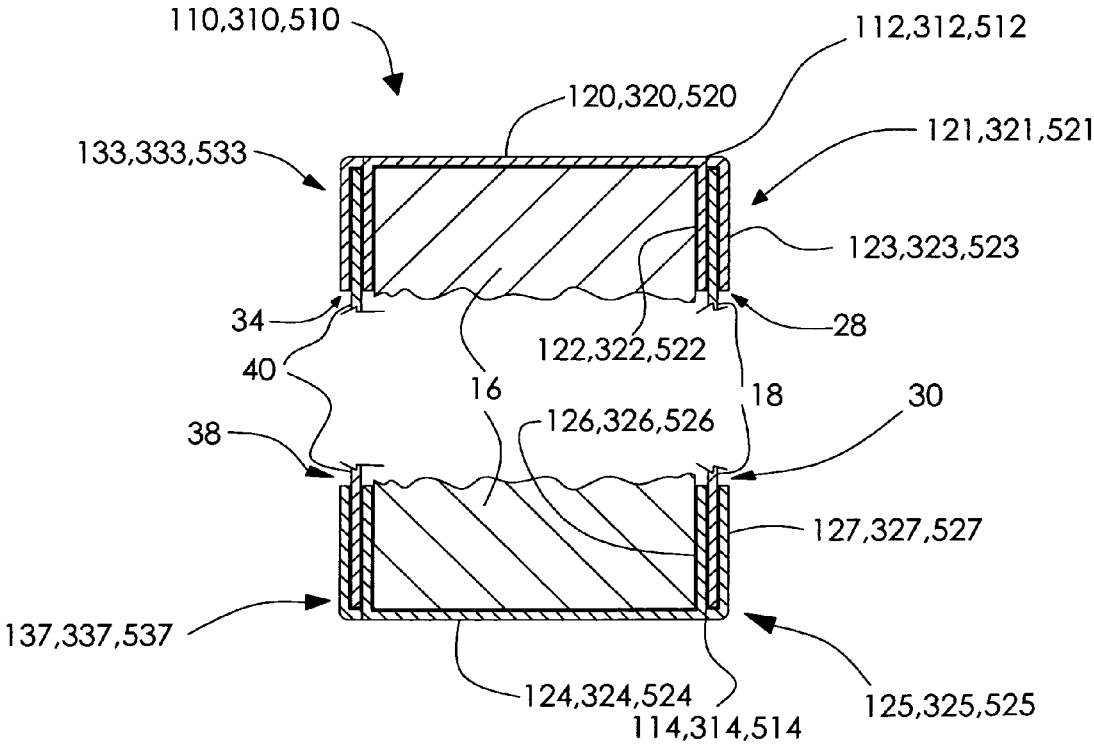
FIG. 5 is a cross sectional view of the header apparatus of FIGS. 4, 7 and 9.

For example, FIGS. 4 and 5 illustrate a header 110 that is constructed in this alternative manner of defining the receiving portions 28, 30 and 34, 38. The header 110 comprises a track member 112. The track member 112 comprises a lateral segment 120 and a bifurcated flange 121 characterized by a segment 122 substantially disposed along a first longitudinal plane and extending substantially orthogonally from the lateral segment 120. Furthermore, the bifurcated flange 121 comprises a second segment 123 substantially disposed along a second longitudinal plane and spatially disposed from the first longitudinal plane establishing a longitudinal gap therebetween defining the receiving portion 28.

Similarly, an opposing track member 114 comprises a lateral segment 124, that is disposable substantially parallel to the lateral segment 120, and a bifurcated flange 125 characterized by a third segment 126 substantially disposed along a third longitudinal plane. Furthermore, the flange 125 comprises a fourth segment 127 substantially disposed along a fourth longitudinal plane and spatially disposed from the third longitudinal plane establishing a longitudinal gap therebetween defining the opposing receiving portion 30. It will be noted that the first and third longitudinal planes of the segments 122, 126 and the second and fourth longitudinal planes of the segments 123, 127 can be nominally coplanar, respectively.

As above, the header 110 can comprise a single web member 18. Alternatively, as shown in FIG. 5, the track members 112, 114 can each comprise a pair of bifurcated flanges 121, 133 and 125, 137, respectively, defining a substantially unshaped arrangement with two receiving portions 28, 34 and 30, 38, respectively. In this manner the header 110 comprises the web member 18 receivingly engaged in the first pair of the opposing receiving portions 28, 30 and the second web member 40 receivingly engaged in the other pair of the opposing receiving portions 34, 38.

Figure 6:
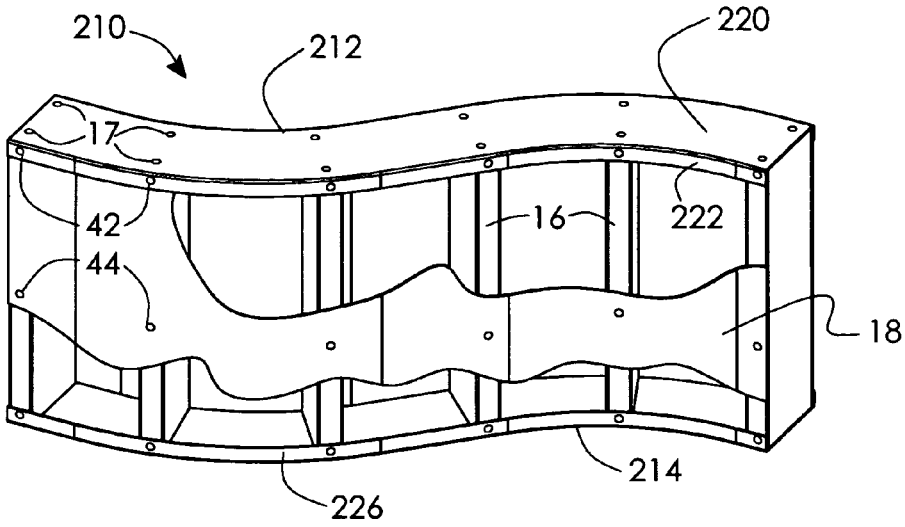
FIG. 6 is a partially cutaway isometric view of an arcuate header apparatus constructed in accordance with embodiments of the present invention.

The embodiments discussed so far contemplate a substantially straight header 10, 110, such as is useful in framing a straight header. In many instances, however, a header is needed in conjunction with a curved wall portion of a framing system. FIG. 6 illustrates a header 210 constructed in accordance with alternative embodiments of the present invention and in contemplation of such curved wall applications.

The header 210 comprises a track member 212 that is characteristically longitudinally arcuate. An opposing track member 214 is disposable substantially parallel to and matches the arcuate shape of the track member 212. The studs 16 are disposed substantially transversely to the track members 212, 214 and attached thereto such as by fasteners 17.

It will be noted that the studs 16 above comprise wood while the studs 16 in FIG. 6 comprise metal. In equivalent embodiments either type of stud 16 can be used in any of the embodiments of the present invention. The web member 18 is characteristically conformable to the arcuate shape of the track members 212, 214. For example, in one embodiment the web member 18 comprises sheet metal. Alternatively, the track members 212, 214, the studs 16, and the web member 18 can comprise any suitable construction material including without limitation steel, wood, plastics, composites and the like as desired.

The embodiment illustrated in FIG. 6 is similarly constructed to that of FIGS. 1 and 2 in that the web member 18 is receivingly engaged between the track member 212, 214 and the studs 16. Referring to FIGS. 2 and 6, the track member 212 comprises a lateral segment 220 and a flange 222 extending substantially orthogonally from the lateral segment 220. The track member 214 similarly comprises a lateral segment 224 disposable substantially parallel to the lateral segment 220 and a flange 226 opposing the flange 222. The adjacent lateral segments 220, 224 and flanges 222, 226 intersect to define the respective receiving portions 28, 30 wherein the web member 18 is receivingly engaged between the studs 16 and the flanges 222, 226.

Although only one web member 18 is contemplated, FIG. 2 illustrates alternatively a header 210 employing opposing web members 18, 40. Accordingly, the track member 212 comprises the flange 222 and an opposing flange 232 defining a substantially unshaped arrangement with two receiving portions 28, 34. Likewise, the track member 214 comprises opposing flanges 226, 236. The header 210 thus comprises the web member 18 receivingly engaged in the receiving portions 28, 30 between the studs 16 and the flanges 222, 226 and the web member 40 receivingly engaged in the receiving portions 34, 38 between the studs 16 and the flanges 232, 236.

Figure 7:
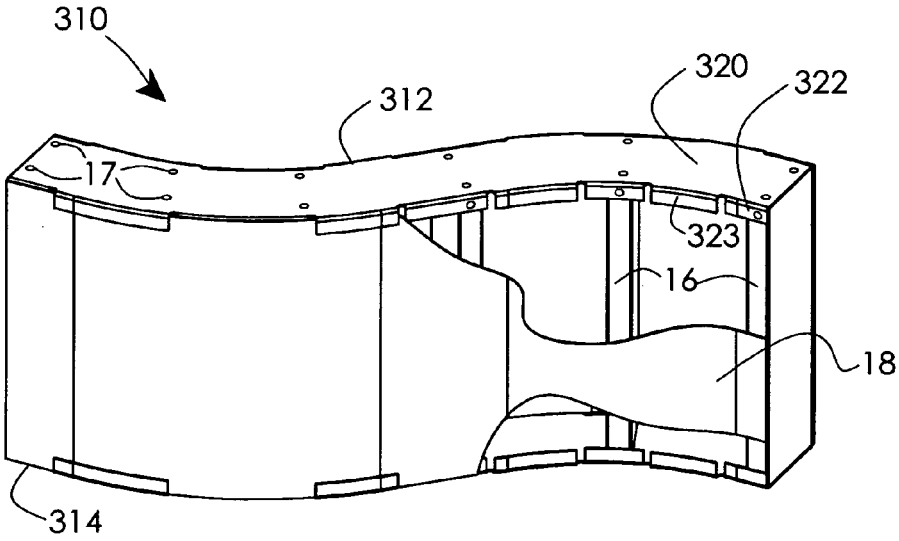
FIG. 7 is a partially cutaway isometric view of an arcuate header apparatus constructed in accordance with alternative embodiments of the present invention.

FIGS. 5 and 7 illustrate a header 310 constructed in accordance with embodiments similar to that of FIG. 4 in that the web member 18 is receivingly engaged within a receiving portion defined solely by the track members. More particularly, the header 310 comprises a track member 312 and an opposing track member 314. The track member 312 comprises a lateral segment 320 and a bifurcated flange 321 characterized by a segment 322 substantially disposed along a first longitudinal plane and extending substantially orthogonally from the lateral segment 320. Furthermore, the flange 321 comprises a second segment 323 substantially disposed along a second longitudinal plane and spatially disposed from the first longitudinal plane establishing a longitudinal gap therebetween defining the receiving portion 28.

Similarly, the opposing track member 314 comprises a lateral segment 324 that is disposable substantially parallel to the lateral segment 320 and a bifurcated flange 325 characterized by a third segment 326 substantially disposed along a third longitudinal plane. Furthermore, the flange 325 comprises a fourth segment 327 substantially disposed along a fourth longitudinal plane and spatially disposed from the third longitudinal plane establishing a longitudinal gap therebetween defining the opposing receiving portion 30. It will be noted that the first and third longitudinal planes of the segments 322, 326 and the second and fourth longitudinal planes of the segments 323, 327 can be nominally coplanar, respectively.

As above, the header 310 can comprise a single web member 18. Alternatively, as shown in FIG. 5, the track members 312, 314 can each comprise a pair of bifurcated flanges 321, 333 and 325, 337, respectively, defining a substantially u-shaped arrangement with two receiving portions 28, 34 and 30, 38, respectively. In this manner the header 310 comprises the web member 18 receivingly engaged in the first pair of the opposing receiving portions 28, 30 and the second web member 40 receivingly engaged in the other pair of the opposing receiving portions 34, 38.

The embodiments discussed heretofore have contemplated headers comprising substantially fixed-shaped track members, whether they are straight (such as FIG. 1) or arcuate (such as FIG. 6). In an alternative embodiment a header 410 illustrated in FIGS. 2 and 8 comprises track members formed by a plurality of flexibly joined sections that are selectively moveable to orient the track members in a desired shape. One example of such an arrangement comprising pivotally connected segments forming the flexible track members is taught in U.S. Pat. No. 6,000,181 entitled APPARATUS AND METHODS OF FORMING A CURVED STRUCTURE which is assigned to the assignee of the present invention and incorporated herein by reference. Another example of such an arrangement, not illustrated, comprising an accordion-type unitary construction is taught in U.S. Pat. No. 6,237,301 entitled FLEXIBLE RUNNER. For purposes of the embodiments of the present invention, "flexibly joined sections" contemplates pivotally connected sections, mechanically linked sections, and unitary construction and equivalent alternatives thereto.

Figure 8:
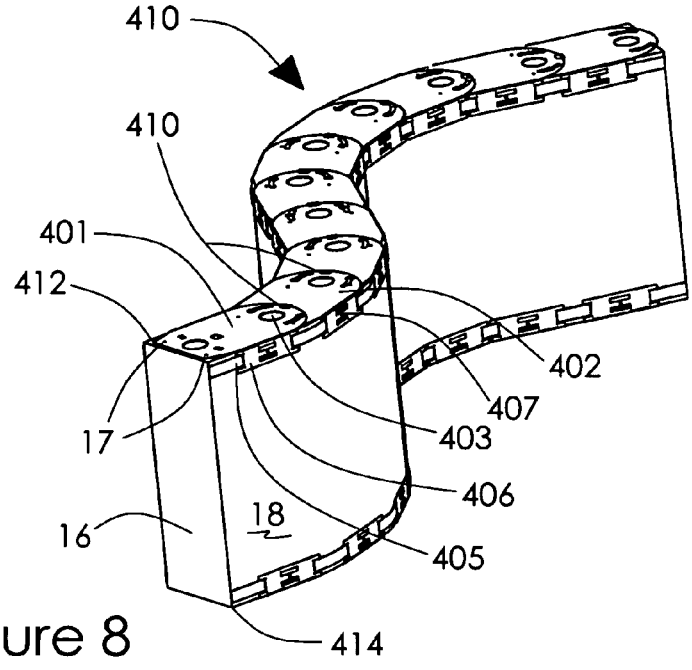
FIG. 8 is an isometric view of a flexibly arcuate header apparatus constructed in accordance with alternative embodiments of the present invention.

More particularly, the header 410 has a track member 412 and an opposing track member 414., The track member 412 has a track segment 401 that is journalled to a track segment 402 by a crimp connection 403 therebetween. This permits a sliding pivotally moveable relationship between the segments 401, 402 for imparting a desired shape to the track member 412. This segmented and journalled construction is repeated to establish a flexible track member 412 that can be placed in a desired arcuate or straight arrangement. Once the desired arrangement is achieved, any of a number of retention procedures can be used to retain the desired shape. For example, the overlapping segments 401, 402 can be fixed by a fastener 410 or by a crimping operation, by a bendable tab, or by other material interference means. Additionally, as shown in FIG. 8, a strap 405 can be passed through slotted flanges 406 and used as an anchoring member by driving a fastener 407 through the strap 405 and into a respective stud 16. Alternatively, as taught in U.S. Pat. No. 6,000,181, the strap 405 can be provided as a portion of each of the segments 401, 402. As above, the web member 18 is characteristically conformable to assume the arcuate shape of the track members 412, 414. In a preferred embodiment the web member 18 comprises sheet metal.

The embodiment illustrated in FIGS. 2 and 8 is similarly constructed to that of FIG. 1 to the extent that the web member 18 is receivingly engaged between the track member 412, 414 and the studs 16. That is, the track member 412 comprises a lateral segment 420 and a flange 422 extending substantially orthogonally from the lateral segment 420. The track member 414 similarly comprises a lateral segment 424 disposable substantially parallel to the lateral segment 420 and a flange 426 opposing the flange 422. The adjacent lateral segments 420, 424 and flanges 422, 426 intersect to define the respective receiving portions 28, 30 wherein the web member 18 is receivingly engaged in the receiving portions 28, 30 between the studs 16 and the flanges 422, 426.

Although only the one web member 18 is contemplated, the embodiments of FIG. 2 illustrates employing opposing web members 18, 40. Accordingly, the track member 412 comprises the flange 422 and an opposing flange 432 defining a substantially u-shaped arrangement with two receiving portions 28, 34. Similarly, the track member 414 comprises the flange 426 and an opposing flange 436 defining a substantially u-shaped arrangement with two receiving portions 30, 38. The header 410 thus comprises the web member 18 receivingly engaged in the receiving portions 28, 30 between the studs 16 and the flanges 422, 426, and the web member 40 receivingly engaged in the receiving portions 34, 38 between the studs 16 and the flanges 432, 436.

Figure 9:
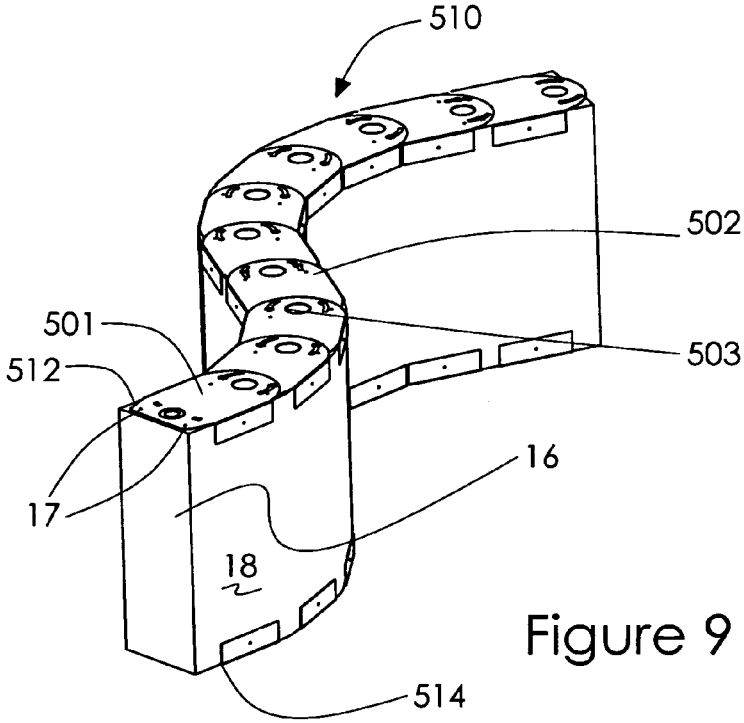
FIG. 9 is an isometric view of a flexibly arcuate header constructed in accordance with alternative embodiments of the present invention.

FIGS. 5 and 9 show a header 510 comprising a plurality of pivotally joined segments like the embodiment of FIG. 8, but wherein the web member 18 is receivingly engaged within receiving portions defined solely by the track members. More particularly, the header 510 comprises a track member 512 and an opposing track member 514. The track member 512 comprises a track segment 501 that is journalled to a track segment 502 such as by a crimp connection 503. FIG. 5 shows the track segment 501, for example, comprises a lateral segment 520 and a bifurcated flange 521 characterized by a segment 522 substantially disposed along a first longitudinal plane and extending substantially orthogonally from the lateral segment 520. Furthermore, the bifurcated flange 521 comprises a second segment 523 substantially disposed along a second longitudinal plane and spatially disposed from the first longitudinal plane establishing a longitudinal gap therebetween defining the receiving portion 28.

Similarly, the opposing track member 514 comprises a lateral segment 524 that is disposable substantially parallel to the lateral segment 520 and a bifurcated flange 525 characterized by a third segment 526 substantially disposed along a third longitudinal plane. Furthermore, the flange 525 comprises a fourth segment 527 substantially disposed along a fourth longitudinal plane and spatially disposed from the third longitudinal plane establishing a longitudinal gap therebetween defining the opposing receiving portion 30.

As above, the header 510 can comprise a single web member 18. Alternatively, as shown in FIG. 5, the track members 512, 514 can each comprise a pair of bifurcated flanges 521, 533 and 525, 537, respectively, defining a substantially unshaped arrangement with two receiving portions 28, 34 and 30, 38, respectively. In this manner the header 510 comprises the web member 18 receivingly engaged in the first pair of the opposing receiving portions 28, 30 and the second web member 40 receivingly engaged in the other pair of the opposing receiving portions 34, 38.

Figure 10:
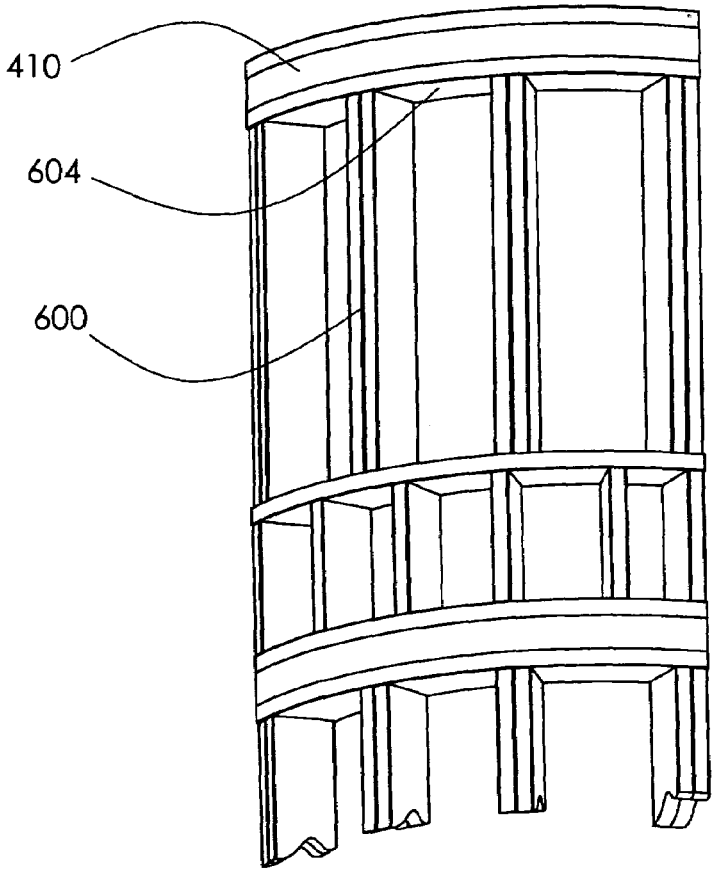
FIG. 10 is an elevational view of a structural framing system including a header apparatus contemplated by the embodiments of the present invention.

FIG. 10 illustrates a structural framing system for an arcuate wall 600 of a building, comprising the header 410 spanning an opening for accommodating windows. It will be noted that the header 410 can be placed above and/or below a nailer board 604 for ease in framing members that connect to the header 410.

Figure 11:
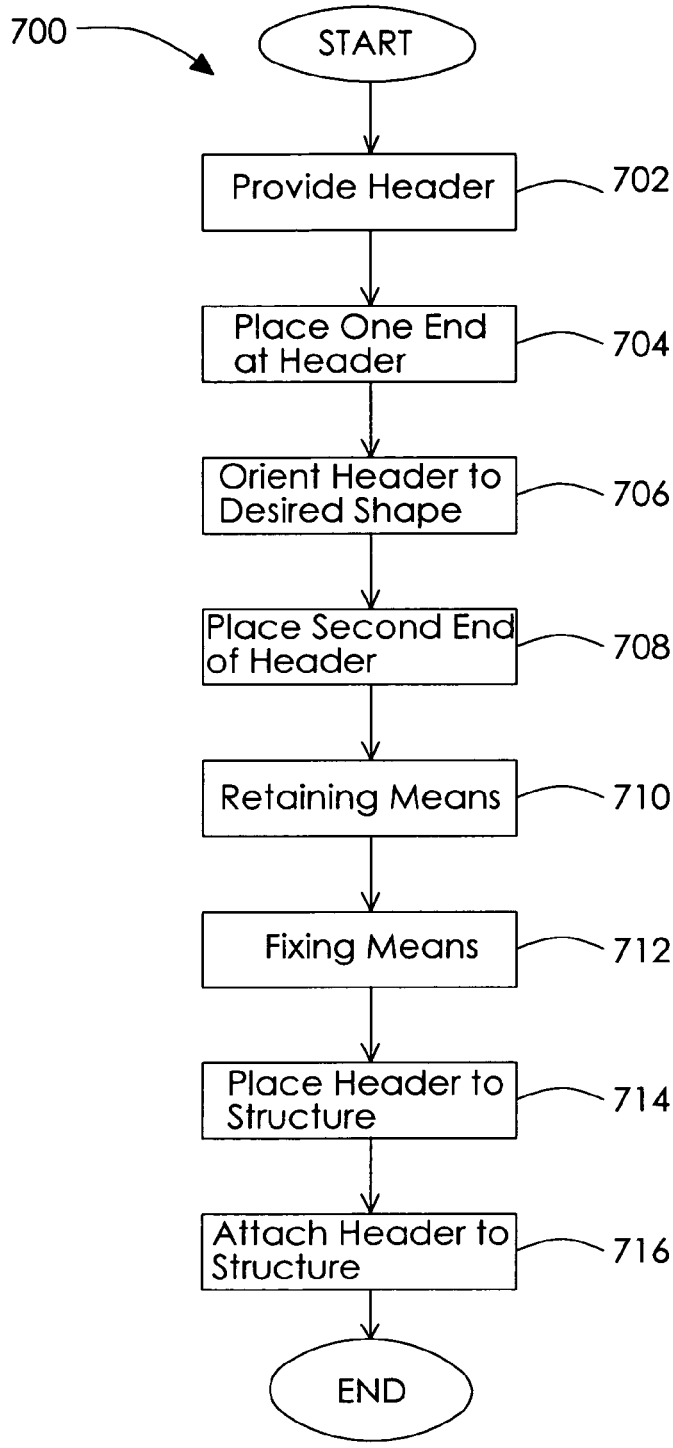
FIG. 11 is a flowchart of a method contemplated by the embodiments of the present invention.

The embodiments of the present invention further contemplate a method for framing a header spanning supporting portions of a structural framing system. FIG. 11 is a flowchart of a method 700 for constructing such a header 410 as contemplated by the embodiments of the present invention.

The method 700 begins at block 702 by providing a header apparatus, such as header 410, comprising opposing tracks 412, 414 with the plurality of studs 16 interposed substantially transversely therebetween. The tracks 412, 414 define receiving portions 28, 30 receivingly engaging the structural web member 18.

The method 700 continues at block 704 in placing one end of the header apparatus 410 in a reference location. The end of the header can be attached to a portion of the structural framing system when framing the header in place. Alternatively, the header apparatus 410 can be shaped and retained in place on the ground, as described below, and then placed to the structural framing system. At block 706 the header 410 is oriented in a desired longitudinal shape by moving the flexibly connected segments forming the track members. At block 708 a second end of the header 410 is placed in the position corresponding to the desired shape. Again, this may be done be attaching the second end to another portion of the structural framing system, or alternatively to a reference position on the ground.

With the header apparatus 410 oriented in the desired shape, at block 710 the track members are retained in place with a retention member to retain the desired longitudinal shape. The retention member can be a crimp connection interlocking the flexibly connected track segments. Alternatively, the retention member can be a fastener such as a screw or a nail. In block 712 a fixing member is installed to fix the web member to the studs and/or to the track members. The fixing member can be any type of fastening device such as but not limited to a screw or a nail.

The header apparatus is now a unitary structural member that, if built off-site, can be placed into the structural framing system in block 714 and attached to the structural framing system in block 716. In one embodiment, as described above, the web member 18 can be extended beyond the track members 412, 414 and attached to the supporting portions of the structural framing system. Loads can be placed to the header such as framing structure and building components placed above and/or below the header.

Most generally, the embodiments of the present invention contemplate a structural framing system. The framing system comprises a first structural member and a second structural member, and a means for framing a header spanning the structural members. The means for framing is characterized by a pair of track members defining opposing receiving portions; a plurality of column members disposed substantially transversely to the track members and joined thereto; and a web member receivingly engaged in the receiving portions and spanning the column members.

Furthermore, the means for framing can be characterized by a first of the pair of track members comprising a lateral segment and a flange extending substantially orthogonally from the lateral segment, the second of the pair of track members comprising a lateral segment disposable substantially parallel to the first track member lateral segment and a flange opposing the first track member flange, each of the adjacent lateral segments and flanges intersecting to define the respective receiving portions.

Alternatively, the means for framing can be characterized by a first of the pair of track members comprising a lateral segment and a bifurcated flange extending substantially orthogonally from the lateral segment, the bifurcated flange comprising a first segment substantially disposed along a first longitudinal plane and a second segment substantially disposed along a second longitudinal plane and spatially disposed from the first longitudinal plane establishing a longitudinal gap therebetween defining the receiving portion, the second of the pair of track members comprising a lateral segment disposable substantially parallel to the first track member lateral segment and a bifurcated flange opposing the first track member flange with a third segment substantially disposed along a third longitudinal plane and a fourth segment substantially disposed along a fourth longitudinal plane and spatially disposed from the third longitudinal plane establishing a gap therebetween defining the opposing receiving portion.

In some embodiments the means for framing is characterized by the track members being characteristically longitudinally arcuate and the web member being characteristically conformable to the arcuate shape of the track members. For example, the means for framing can be characterized by at least one of the track members comprising a plurality of flexibly joined sections that are moveable to define a selected arcuate longitudinal shape, wherein the web member is characteristically conformable to assume the arcuate shape of the track members.

The means for framing expressly does not contemplate known methods of custom fabricating header members to span the first and second structural members. Such solutions require highly skilled framing artisans, especially when an arcuate header is needed. The means for framing herein, rather, as defined by the proper construction of the appended claims, contemplates a self-contained and modular header apparatus comprising a pair of opposing track members defining opposing receiving portions, a plurality of column members disposed substantially transversely to the track members and joined thereto, and a web member receivingly engaged in the receiving portions and spanning the column members. The means for framing is further characterized by the web member being slidingly engaged within the receiving portions until such time that the header is oriented in a desired shape. The web member is then fixed to the column members and/or the track members to provide a unitary structural beam.

Figure 12:
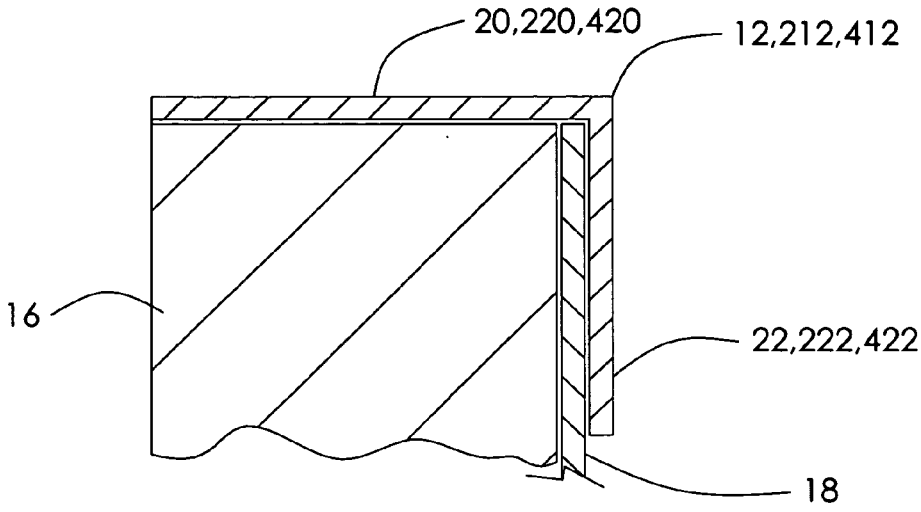
FIGS. 12 and 13 are cross sectional views of track members constructed in accordance with alternative embodiments for use with only one web member.
Figure 13:
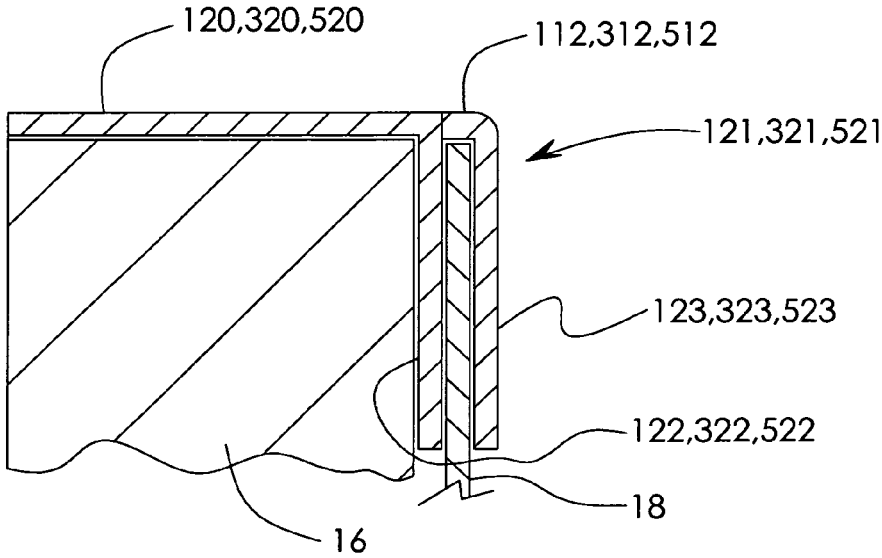

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, construction of the receiving portions may vary while maintaining substantially the same functionality without departing from the scope and spirit of the present invention. Furthermore, alternative embodiments such as in FIGS. 12 and 13 can employ only one web member 18 rather than two. Also, as in FIGS. 8 and 9, complex curves such as serpentine curved headers can be framed in equivalent alternative embodiments. In addition, although the preferred embodiment described herein is directed to a header structural support member, it will be appreciated by those skilled in the art that the teachings of the present invention can be applied to other systems, so as to form roofing systems and archways, for example, without departing from the scope and spirit of the present invention.

What is claimed is:

1. A structural framing system comprising:

a first support member;

a second support member spatially disposed from the first support member defining a space between the support members;

a header apparatus comprising:

a pair of track members defining opposing receiving portions, wherein at least one of the track members comprises a plurality of flexibly joined sections that are selectively moveable to define an arcuate longitudinal shape;

a plurality of column members disposed substantially transversely to the track members and joined thereto;

a web member receivingly engaged in the receiving portions of both track members and covering the column members therebetween, wherein the web member is characteristically conformable to assume the arcuate shape of the track member; and fixing members fixing the web member to both of the track members and to one or more of the column members to define a unitary structural member being operably supported adjacent the opening only by attachment of a first portion and a second portion of the unitary structural member to the first and second support members, respectively, wherein medial portions of the unitary structural member between the first and second portions thereof are clearingly detached from the first and second support members and span the opening therebetween, the unitary structural member thereby transferring the support forces of the first and second support members to a distributed force array acting along the medial portion of the unitary structural member.

2. The apparatus of claim 1 wherein a first of the pair of track members comprises a lateral segment and a flange extending substantially orthogonally from the lateral segment, and wherein a second of the pair of track members comprises a lateral segment disposable substantially parallel to the first track member lateral segment and a flange opposing the first track member flange, each of the adjacent lateral segments and flanges intersecting to define the respective receiving portions.

3. The apparatus of claim 2 wherein the web member is receivingly engaged between the columns and the flanges.

4. The apparatus of claim 2 wherein each of the track members comprises a pair of flanges defining a substantially u-shaped arrangement with two receiving portions, the apparatus comprising a first web member receivingly engaged between the columns and a first pair of opposing flanges and a second web member receivingly engaged between the columns and the other pair of opposing flanges.

5. The apparatus of claim 2 wherein a first of the pair of track members comprises a lateral segment and a bifurcated flange extending substantially orthogonally from the lateral segment, the bifurcated flange comprising a first segment disposed substantially along a first longitudinal plane and a second segment disposed substantially along a second longitudinal plane and spatially disposed from the first longitudinal plane establishing a longitudinal gap therebetween defining the receiving portion, and wherein a second of the pair of track members comprises a lateral segment disposable substantially parallel to the first track member lateral segment and a bifurcated flange opposing the first track member bifurcated flange with a third segment disposed substantially along a third longitudinal plane and a fourth segment disposed substantially along a fourth longitudinal plane and spatially disposed from the third longitudinal plane establishing a longitudinal gap therebetween defining the opposing receiving portion.

6. The apparatus of claim 5 wherein each of the track members comprises a pair of bifurcated flanges defining a substantially u-shaped arrangement with two receiving portions, the apparatus comprising a first web member receivingly engaged in a first pair of the opposing receiving portions and a second web member receivingly engaged in the other pair of the opposing receiving portions.

7. The apparatus of claim 1 wherein the other track member is characteristically arcuate and the web member is characteristically conformable to the arcuate shape of the track members.

8. The apparatus of claim 7 wherein a first of the pair of track members comprises a lateral segment and a flange extending substantially orthogonally from the lateral segment, and wherein a second of the pair of track members comprises a lateral segment disposable substantially parallel to the first track member lateral segment and a flange opposing the first member flange, each of the adjacent lateral segments and flanges intersecting to define the respective receiving portions.

9. The apparatus of claim 8 wherein the web member is receivingly engaged between the columns and the flanges.

10. The apparatus of claim 8 wherein each of the track members comprises a pair of flanges defining a substantially u-shaped arrangement with two receiving portions, the apparatus comprising a first web member receivingly engaged between the columns and a first pair of opposing flanges and a second web member receivingly engaged between the columns and the other pair of opposing flanges.

11. The apparatus of claim 7 wherein a first of the pair of track members comprises a lateral segment and a bifurcated flange extending substantially orthogonally from the lateral segment, the bifurcated flange comprising a first segment disposed substantially along a first longitudinal plane and a second segment disposed substantially along a second longitudinal plane and spatially disposed from the first longitudinal plane establishing a longitudinal gap therebetween defining the receiving portion, and wherein a second of the pair of track members comprises a lateral segment disposable substantially parallel to the first track member lateral segment and a bifurcated flange opposing the first track member bifurcated flange with a third segment disposed substantially along a third longitudinal plane and a fourth segment disposed substantially along a fourth longitudinal plane and spatially disposed from the third longitudinal plane establishing a longitudinal gap therebetween defining the opposing receiving portion.

12. The apparatus of claim 11 wherein each of the track members comprises a pair of bifurcated flanges defining a substantially u-shaped arrangement with two receiving portions, the apparatus comprising a first web member receivingly engaged in a first pair of the opposing receiving portions and a second web member receivingly engaged in the other pair of the opposing receiving portions.

13. The apparatus of claim 1 wherein each of the track members comprises a plurality of flexibly joined sections that are selectively moveable to define an arcuate longitudinal shape, wherein the web member is characteristically conformable to assume the arcuate shape of the track members.

14. The apparatus of claim 13 wherein a first of the pair of track members comprises a lateral segment and a flange extending substantially orthogonally from the lateral segment, and wherein a second of the pair of track members comprises a lateral segment disposable parallel to the first track member lateral segment and a flange opposing the first track member flange, each of the adjacent lateral segments and flanges intersecting to define the respective receiving portions.

15. The apparatus of claim 14 wherein the web member is receivingly engaged between the columns and the flanges.

16. The apparatus of claim 14 wherein each of the track members comprises a pair of flanges defining a substantially u-shaped arrangement with two receiving portions, and comprising a first web member receivingly engaged between the columns and one of the flanges and a second web member receivingly engaged between the columns and the other pair of opposing flanges.

17. The apparatus of claim 13 wherein a first of the pair of track members comprises a lateral segment and a bifurcated flange extending substantially orthogonally from the lateral segment, the bifurcated flange comprising a first segment disposed substantially along a first longitudinal plane and a second segment disposed substantially along a second longitudinal plane and spatially disposed from the first longitudinal plane establishing a longitudinal gap therebetween defining the receiving portion, and wherein a second of the pair of track members comprises a lateral segment disposable substantially parallel to the first track member lateral segment and a bifurcated flange opposing the first track member bifurcated flange with a third segment disposed substantially along a third longitudinal plane and a fourth segment disposed substantially along a fourth longitudinal plane and spatially disposed from the third longitudinal plane establishing a longitudinal gap therebetween defining the opposing receiving portion.

18. The apparatus of claim 17 wherein each of the track members comprises a pair of bifurcated flanges defining a substantially u-shaped arrangement with two receiving portions, the apparatus comprising a first web member receivingly engaged in a first pair of the opposing receiving portions and a second web member receivingly engaged in the other pair of the opposing receiving portions.

19. The apparatus of claim 13 further comprising a retention member adapted for interlocking adjacent sections at a desired orientation.

20. A method for framing a header spanning supporting portions of a structural framing system, comprising:

providing a header apparatus comprising:

opposing tracks with at least one of the tracks including a plurality of flexibly joined sections that are selectively moveable to define an arcuate longitudinal shape;

a plurality of studs interposed substantially transversely therebetween the tracks; and a structural web member supported by receiving portions of the tracks in a sliding relationship and spanning the studs, wherein the web member is characteristically conformable to assume the arcuate shape of the track; and attaching a first end of the header apparatus in a reference position to a first support member;

orienting the header apparatus to a desired longitudinal shape;

attaching a second end of the header apparatus to a second support member that is spatially disposed from the first support member and defining an opening between the support members; and fixing the web member to at least one of the studs after orienting the header apparatus to define a unitary structural member transferring support forces of the first and second support members to a distributed force array acting along the medial portion of the unitary structural member.

21. The method of claim 20 comprising, after the placing the first end step, selectively moving the segments to orient the header apparatus in the desired shape.

22. The method of claim 21 comprising, after the moving the segments step, retaining adjacent segments in the desired shape.

23. The method of claim 22 comprising, after the retaining step, placing the header apparatus to the structural framing system.

24. The method of claim 23 comprising, after the placing the header apparatus step, attaching the header apparatus to the structural framing system.

* * * * *